US010913270B2

(12) United States Patent
Nakahara

(10) Patent No.: US 10,913,270 B2
(45) Date of Patent: Feb. 9, 2021

(54) LIQUID DISCHARGE HEAD SUBSTRATE, LIQUID DISCHARGE HEAD AND METHOD OF MANUFACTURING LIQUID DISCHARGE HEAD SUBSTRATE

(71) Applicant: CANON KABUSHIKI KAISHA, Tokyo (JP)

(72) Inventor: Takatoshi Nakahara, Oita (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 38 days.

(21) Appl. No.: 16/377,812

(22) Filed: Apr. 8, 2019

(65) Prior Publication Data

US 2019/0315124 A1 Oct. 17, 2019

(30) Foreign Application Priority Data

Apr. 12, 2018 (JP) ..... 2018-077142

(51) Int. Cl.
*B41J 2/14* (2006.01)
*B41J 2/16* (2006.01)

(52) U.S. Cl.
CPC ..... *B41J 2/14129* (2013.01); *B41J 2/1601* (2013.01); *B41J 2/1642* (2013.01)

(58) Field of Classification Search
CPC .... B41J 2/14129; B41J 2/1601; B41J 2/1642; B41J 2/14072; B41J 2/14112; B41J 2002/14491
See application file for complete search history.

(56) References Cited

U.S. PATENT DOCUMENTS 5,742,307 A * 4/1998 Watrobski et al. .. B41J 2/14129
2005/0097716 A1* 5/2005 Takaduwa et al. ..... B41J 2/161
2009/0015608 A1 1/2009 Han et al.
2009/0040276 A1 2/2009 North et al.
(Continued)

FOREIGN PATENT DOCUMENTS

CN 1322980 C 6/2007
CN 105818537 A 8/2016
(Continued)

OTHER PUBLICATIONS

Office Action dated Sep. 14, 2020, in counterpart CN 201910293146.2 (11 pages).

*Primary Examiner* — Juanita D Jackson
(74) *Attorney, Agent, or Firm* — Venable LLP

(57) ABSTRACT

A liquid discharge head substrate is provided. The head substrate comprises a substrate, an insulator arranged above the substrate, conductive patterns arranged in the insulator, a heat generating resistive element arranged above the insulator, a protective layer covering the heat generating resistive element, and electrode plugs configured to connect the heat generating resistive element and the conductive patterns. The heat generating resistive element and the electrode plugs are arranged in contact with each other to overlap each other. A current flows through the heat generating resistive element in a first direction. In the first direction, a length of the electrode plug is smaller than a length of the heat generating resistive element and in a second direction crossing the first direction, a length of the electrode plug is larger than a length of the heat generating resistive element.

26 Claims, 12 Drawing Sheets

(56) References Cited

U.S. PATENT DOCUMENTS

| | | | |
|---|---|---|---|
| 2010/0214362 | A1 | 8/2010 | Silverbrook |
| 2015/0336385 | A1 | 11/2015 | Kato et al. |

FOREIGN PATENT DOCUMENTS

| | | | |
|---|---|---|---|
| CN | 106042645 | A | 10/2016 |
| JP | 2008-149666 | A | 7/2008 |
| JP | 2008-260149 | A | 10/2008 |
| JP | 2008-260150 | A | 10/2008 |
| JP | 2016-137705 | A | 8/2016 |

* cited by examiner

LIQUID DISCHARGE HEAD SUBSTRATE, LIQUID DISCHARGE HEAD AND METHOD OF MANUFACTURING LIQUID DISCHARGE HEAD SUBSTRATE

BACKGROUND OF THE INVENTION

Field of the Invention

The present invention relates to a liquid discharge head substrate, a liquid discharge head and a method of manufacturing the liquid discharge head substrate.

Description of the Related Art

A liquid discharge head substrate includes an element that applies energy to a liquid to discharge the liquid. Japanese Patent Laid-Open No. 2016-137705 discloses a liquid discharge head substrate using a heat generating resistive element that applies energy to a liquid.

SUMMARY OF THE INVENTION

In a structure disclosed in Japanese Patent Laid-Open No. 2016-137705, when forming an electrode plug, a metal for forming the electrode plug is sometimes unsatisfactorily buried and the surface of the formed electrode plug becomes uneven. The unevenness is readily generated near an end in the long-side direction in the case of a shape described in the fourth embodiment of Japanese Patent Laid-Open No. 2016-137705. The uneven surface of the electrode plug may hinder a protective layer formed on a heat generating resistive element arranged on the electrode plug from uniformly covering the heat generating resistive element. If part of the heat generating resistive element is not covered with the protective layer, a liquid such as ink reaches the heat generating resistive element to generate a potential difference between the electrode plug at a positive potential and the liquid at the ground potential via the heat generating resistive element during the operation of the heat generating resistive element. Owing to the potential difference, the protective layer is dissolved by an electrolysis operation and the durability of the liquid discharge head substrate may decrease.

Embodiments of the present invention provide a technique advantageous in improving the durability of a liquid discharge head substrate.

According to some embodiment, a liquid discharge head substrate comprising: a substrate; an insulating layer arranged above a surface of the substrate; conductive patterns arranged in the insulating layer; a heat generating resistive element arranged above the insulating layer and configured to generate heat energy for discharging a liquid; a protective layer covering the heat generating resistive element; and electrode plugs electrically connecting the heat generating resistive element and the conductive patterns, wherein the heat generating resistive element and the electrode plugs are arranged in contact with each other and are arranged such that an orthogonal projection of the heat generating resistive element onto the surface of the substrate overlaps with orthogonal projections of the electrode plugs onto the surface of the substrate, a current flows through the heat generating resistive element in a first direction parallel to the surface of the substrate, a length of the electrode plug in the first direction is smaller than a length of the heat generating resistive element in the first direction, and in a second direction parallel to the surface of the substrate and crossing the first direction, a length of the electrode plug in the second direction is larger than a length of the heat generating resistive element in the second direction, is provided.

According to some other embodiment, a liquid discharge head substrate comprising: a substrate; an insulating layer arranged above a surface of the substrate; a heat generating resistive element arranged above the insulating layer and configured to generate heat energy for discharging a liquid; a protective layer covering the heat generating resistive element; a first conductive pattern and a second conductive pattern arranged in the insulating layer; a first electrode plug configured to electrically connect the heat generating resistive element and the first conductive pattern; and a second electrode plug configured to electrically connect the heat generating resistive element and the second conductive pattern, wherein the first electrode plug and the second electrode plug are arranged in contact with the heat generating resistive element and are arranged such that an orthogonal projection of the heat generating resistive element onto the surface of the substrate overlaps with each orthogonal projection of the first and second electrode plugs onto the surface of the substrate, the first electrode plug and the second electrode plug are aligned in a first direction parallel to the surface of the substrate, and in a second direction parallel to the surface of the substrate and crossing the first direction, a length of each of the first electrode plug and the second electrode plug in the second direction is larger than a length of the heat generating resistive element in the second direction, is provided.

According to still other embodiment, a method of manufacturing a liquid discharge head substrate, comprising: forming, on a surface of a substrate, an insulating layer in which conductive patterns are buried; forming, in the insulating layer, grooves through which the conductive patterns are exposed at bottoms of openings; forming electrode plugs by filling the grooves with a conductive material; forming a heat generating resistive element that is electrically connected to the electrode plugs and generates heat energy for discharging a liquid; and forming a protective layer to cover the heat generating resistive element, wherein the heat generating resistive element and the electrode plugs are arranged in contact with each other and are arranged such that an orthogonal projection of the heat generating resistive element onto the surface of the substrate overlaps with orthogonal projections of the electrode plugs onto the surface of the substrate, a current flows through the heat generating resistive element in a first direction parallel to the surface of the substrate, a length of the electrode plug in the first direction is smaller than a length of the heat generating resistive element in the first direction, and in a second direction parallel to the surface of the substrate and crossing the first direction, a length of the electrode plug in the second direction is larger than a length of the heat generating resistive element in the second direction, is provided.

According to some still other embodiment, a method of manufacturing a liquid discharge head substrate, comprising: forming, on a surface of a substrate, an insulating layer in which a first conductive pattern and a second conductive pattern are buried; forming, in the insulating layer at an interval in a first direction parallel to the surface of the substrate, a first groove through which the first conductive pattern is exposed at a bottom of an opening and a second groove through which the second conductive pattern is exposed at a bottom of an opening; forming a first electrode plug and a second electrode plug by filling the first groove and the second groove with a conductive material, respectively; forming a heat generating resistive element that electrically connects the first electrode plug and the second electrode plug and generates heat energy for discharging a liquid; and forming a protective layer to cover the heat generating resistive element, wherein in a second direction parallel to the surface of the substrate and crossing the first direction, a length of each of the first electrode plug and the second electrode plug in the second direction is larger than a length of the heat generating resistive element in the second direction, is provided.

Further features of the present invention will become apparent from the following description of exemplary embodiments (with reference to the attached drawings).

DESCRIPTION OF THE EMBODIMENTS

Embodiments of a liquid discharge head substrate according to the present invention will now be described in detail with reference to the accompanying drawings. In the following description and drawings, common signs denote common arrangements throughout a plurality of drawings. Common arrangements will be described by mutually referring to a plurality of drawings, and a description of arrangements denoted by common signs will be omitted appropriately.

Figure 1A:
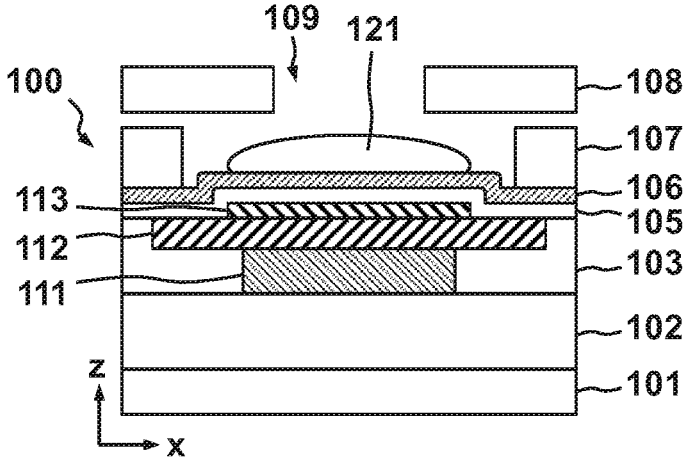
FIGS. 1A and 1B are views showing an example of the structure of a liquid discharge head substrate according to an embodiment of the present invention.
Figure 1B:
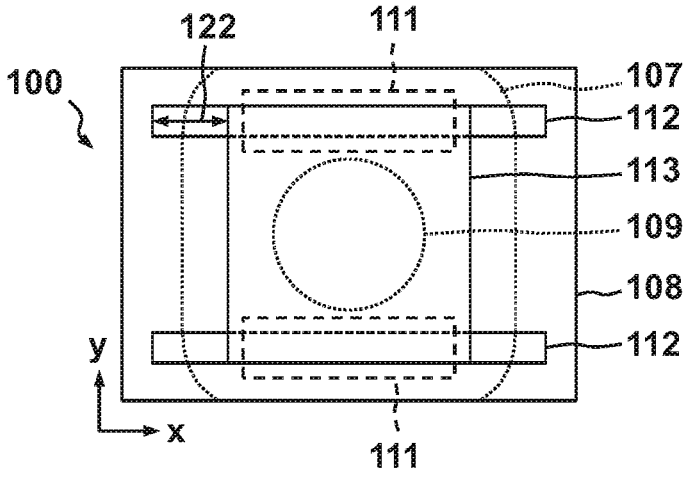

The structure and manufacturing method of a liquid discharge head substrate according to an embodiment of the present invention will be described with reference to FIGS. 1A to 3H. FIGS. 1A and 1B are a sectional view and a plan view, respectively, showing the structure of a liquid discharge head substrate 100 according to the first embodiment of the present invention.

The liquid discharge head substrate 100 includes a substrate 101, insulating layers 102 and 103, conductive patterns 111, a heat generating resistive element 113, a protective layer 105, and electrode plugs 112. For example, a semiconductor substrate of silicon or the like is used for the substrate 101. The insulating layers 102 and 103 have insulating properties and are arranged on the surface of the substrate 101. For example, silicon oxide or the like is used for the insulating layers 102 and 103. The conductive patterns 111 are arranged in the insulating layers 102 and 103. For example, a material containing aluminum, copper, or the like is used for the conductive patterns 111. The conductive patterns 111 supply power to the heat generating resistive element 113. FIG. 1A shows the single-layered conductive patterns 111, but the liquid discharge head substrate 100 may include multilayered conductive patterns (wiring patterns). The heat generating resistive element 113 is arranged on the insulating layer 103 and receives power (a current flows) to generate heat energy for discharging a liquid 121. For example, tantalum silicon nitride (TaSiN), tungsten silicon nitride (WSiN), or the like is used for the heat generating resistive element 113. The electrode plugs 112 electrically connect the heat generating resistive element 113 and the conductive patterns 111. The electrode plugs 112 are arranged in the insulating layer 103, are partially exposed on the surface of the insulating layer 103, and directly contact the heat generating resistive element 113. For example, tungsten or the like is used for the electrode plugs 112. The protective layer 105 is arranged on the heat generating resistive element 113, the electrode plugs 112, and the insulating layers 103 to cover them. For example, an insulator such as silicon nitride is used for the protective layer 105.

The liquid discharge head substrate 100 may further include a metal layer 106 on the protective layer 105. The metal layer 106 on the protective layer 105 functions as an anti-cavitation layer and can improve the liquid discharge performance of the liquid discharge head substrate 100. For example, tantalum, iridium, or the like is used for the metal layer 106.

The liquid discharge head substrate 100 further includes, on the protective layer 105, a flow path member 107 arranged to surround the heat generating resistive element 113 in order to form the flow path of the liquid 121 such as ink. When the metal layer 106 is arranged, the flow path member 107 is arranged on the metal layer 106. The liquid discharge head substrate 100 further includes, above the protective layer 105, an orifice member 108 having an orifice 109 for discharging the liquid 121. The orifice 109 is arranged above the heat generating resistive element 113.

Next, the positional relationship between the heat generating resistive element 113 and the electrode plug 112 will be described. The heat generating resistive element 113 and the electrode plug 112 are arranged in contact with each other so that they overlap each other in a projection orthogonal to the surface of the substrate 101, as shown in FIG. 1B. Of directions parallel to the surface of the substrate 101, a direction along a direction in which the current of the heat generating resistive element 113 connected to the two electrode plugs 112 flows is defined as the y direction (the first direction), as shown in FIG. 1B. A direction parallel to the surface of the substrate 101 and crossing the y direction is defined as the x direction (the second direction). The x and y directions may be orthogonal to each other. Also, the depth direction of the liquid discharge head substrate 100 crossing the x and y directions parallel to the surface of the liquid discharge head substrate 100 is defined as the z direction, as shown in FIG. 1A.

As shown in FIG. 1B, the electrode plug 112 can have a rectangular shape whose long side extends in the x direction. That is, a length, or a size, of the electrode plug 112 in the x direction is larger than a length, or a size, of the electrode plug 112 in the y direction. The two electrode plugs 112 are arranged at respective ends of the heat generating resistive element 113 in the y direction. With this arrangement, a current flows through the heat generating resistive element 113 in they direction. A length of the electrode plug 112 in the y direction is smaller than a length of the heat generating resistive element 113 in the y direction in the projection orthogonal to the surface of the substrate 101. In this embodiment, a length of the electrode plug 112 in the x direction is larger than a length of the heat generating resistive element 113 in the x direction. That is, the outer edge of the electrode plug 112 is arranged outside the outer edge of the heat generating resistive element 113 in the x direction. As shown in FIGS. 1A and 1B, the two outer edges of each electrode plug 112 may be arranged outside the outer edges of the heat generating resistive element 113 in the x direction.

If the electrode plug 112 has a rectangular shape as shown in FIG. 1B, a material for forming the electrode plug 112 is sometimes unsatisfactorily buried in the insulating layer 103 in a region where three sides of the electrode plug 112 are close to side walls of a groove as in the vicinity of each end in the x direction. If the surface of the formed electrode plug 112 becomes uneven due to the unsatisfactory burying, the protective layer 105 formed on the electrode plug 112 may not uniformly cover the electrode plug 112 and the heat generating resistive element 113. When the liquid 121 such as ink contacts a region of the electrode plug 112 and the heat generating resistive element 113 that is not covered with the protective layer 105, a potential difference is generated between the electrode plug 112 and the liquid 121 during the operation of the heat generating resistive element 113. Owing to the potential difference, the protective layer 105 is electrolyzed and the durability of the liquid discharge head substrate decreases. To solve this, the outer edge of the electrode plug 112 is arranged outside the outer edge of the heat generating resistive element 113 in the x direction in this embodiment. That is, the end of the electrode plug 112 that may become uneven is arranged outside the heat generating resistive element 113 in the x direction. A flow path through which the liquid 121 passes is arranged to pass above the heat generating resistive element 113 so as to obtain heat energy for discharging the liquid 121. Accordingly, even if the end of the electrode plug 112 becomes uneven, the liquid 121 hardly contacts the end of the electrode plug 112. As a result, the durability of the liquid discharge head substrate 100 can be improved.

As shown in FIG. 1B, each outer edge of the electrode plug 112 in the y direction may overlap the heat generating resistive element 113 in a region of the electrode plug 112 where the electrode plug 112 and the heat generating resistive element 113 overlap each other in the projection orthogonal to the surface of the substrate 101. As shown in FIG. 1B, the electrode plug 112 may be arranged at a position where the outer edge of the electrode plug 112 and that of the heat generating resistive element 113 in the y direction overlap each other. Alternatively, the outer edge of the electrode plug 112 in the y direction may be arranged inside the outer edge of the heat generating resistive element 113.

As shown in FIG. 1B, a length 122 from the outer edge of the electrode plug 112 to that of the heat generating resistive element 113 in the x direction may be larger than a length of the electrode plug 112 in the y direction. As described above, when forming the electrode plug 112, a portion of the end of the electrode plug 112 in the x direction that is surrounded by the side walls of a groove formed in the insulating layer 103 readily becomes uneven. To prevent this, the end of the electrode plug 112 that is surrounded by the side walls of the groove is spaced apart from the heat generating resistive element 113. The reliability of the formed liquid discharge head substrate 100 can therefore be improved.

Next, a method of manufacturing the liquid discharge head substrate 100 according to this embodiment will be explained with reference to FIGS. 2A to 3H. FIGS. 2A to 3H are sectional views and plan views, respectively, showing steps of forming the liquid discharge head substrate 100.

Figure 2A:
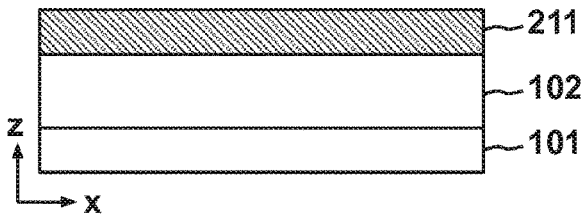
FIGS. 2A to 2H are views showing the manufacturing method of the liquid discharge head substrate in FIGS. 1A and 1B.
Figure 2B:
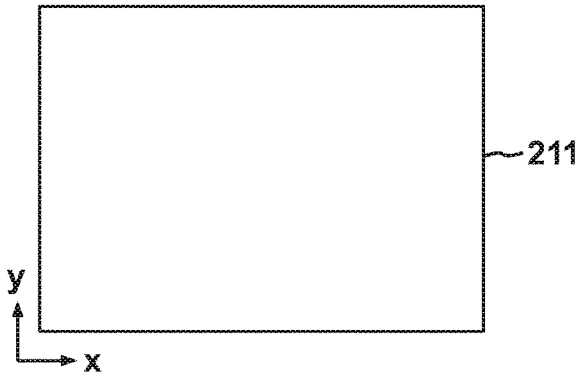

First, as shown in FIGS. 2A and 2B, a conductive material 211 serving as the material of an insulating layer 102 and a conductive pattern is formed on a silicon-used substrate 101. The insulating layer 102 may be formed by thermally oxidizing the silicon-used substrate 101 to deposit silicon oxide, or depositing silicon oxide using CVD or the like. Then, the conductive material 211 containing aluminum-copper (Al—Cu) is deposited on the insulating layer 102 using sputtering or the like. The conductive material is not limited to Al—Cu, and aluminum (Al), aluminum-silicon (Al—Si), aluminum-silicon-copper (Al—Si—Cu), or the like may be used.

Figure 2C:
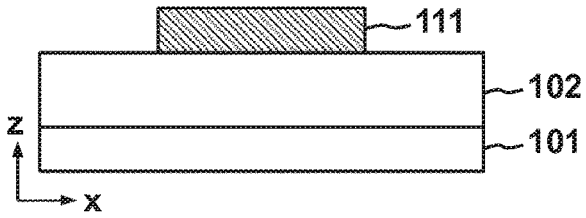
Figure 2D:
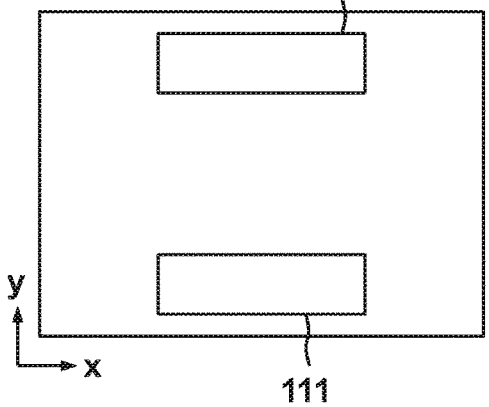

After forming the conductive material 211, a mask pattern is formed to cover a predetermined region of the conductive material 211 using photolithography. A portion of the conductive material 211 that is not covered with the mask pattern is etched using dry etching or the like until the insulating layer 102 is exposed, thereby forming conductive patterns 111 shown in FIGS. 2C and 2D. The two conductive patterns 111 shown in FIGS. 2C and 2D are electrically connected by the heat generating resistive element 113 formed later and are used to supply a current to the heat generating resistive element 113. That is, in the stage shown in FIGS. 2C and 2D, the two conductive patterns 111 are electrically insulated from each other.

Figure 2E:
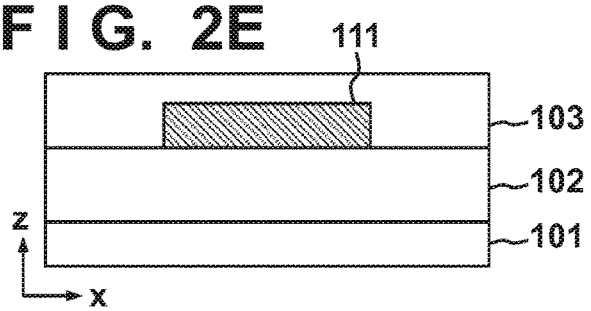
Figure 2F:
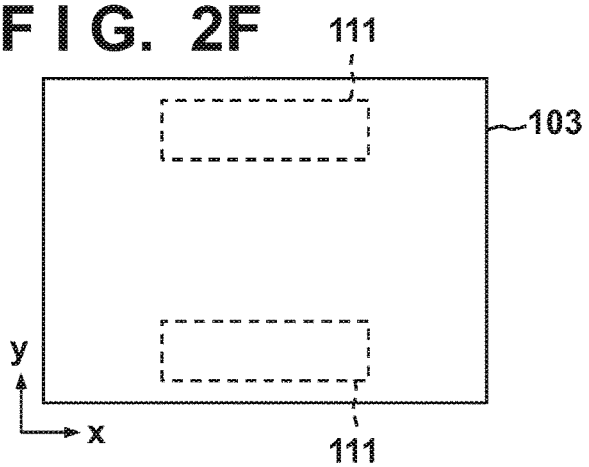

As shown in FIGS. 2E and 2F, an insulating layer 103 is formed on the insulating layer 102 and the conductive patterns 111. The insulating layer 103 may be formed from, for example, silicon oxide using CVD or the like. Accordingly, the insulating layers 102 and 103 in which the conductive patterns 111 are buried are formed on the surface of the substrate 101.

Figure 2G:
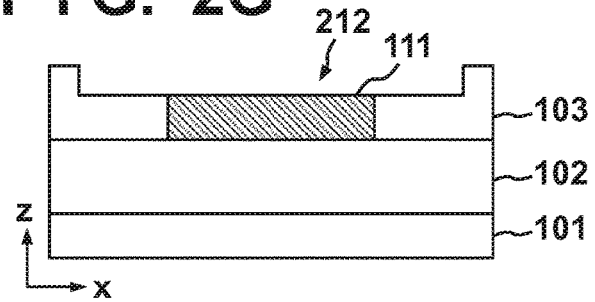
Figure 2H:
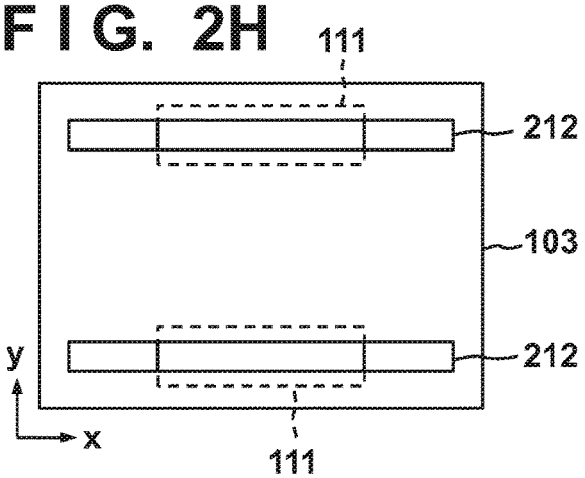

After forming the insulating layer 103, a mask pattern is formed to cover a predetermined region of the insulating layer 103 using photolithography. A portion of the insulating layer 103 that is not covered with the mask pattern is etched using dry etching or the like until the conductive patterns 111 are exposed. As a result, two grooves 212 extending in the x direction through which the respective conductive patterns 111 are exposed at the bottoms of the openings are formed at an interval in the y direction, as shown in FIGS. 2G and 2H.

Figure 3A:
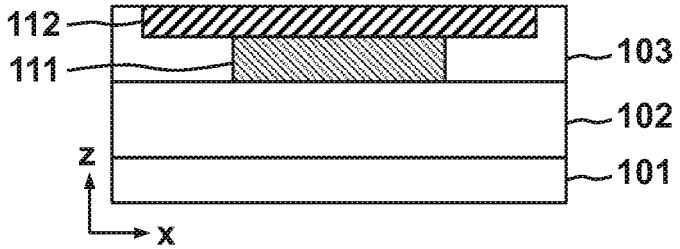
FIGS. 3A to 3H are views showing the manufacturing method of the liquid discharge head substrate in FIGS. 1A and 1B.
Figure 3B:
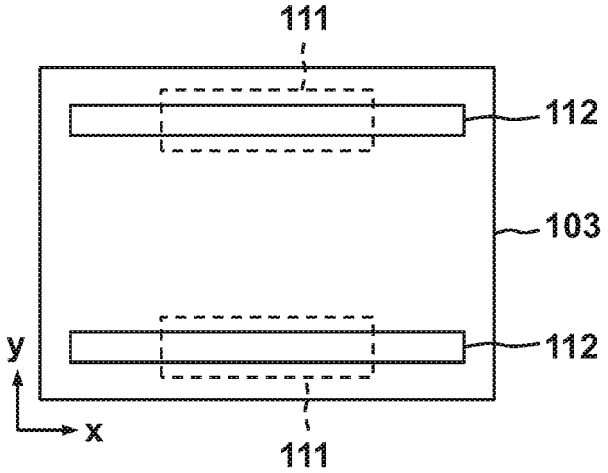

After forming the grooves 212, the grooves 212 formed in the insulating layer 103 are filled with a conductive material containing tungsten or the like using CVD or sputtering. The conductive material is planarized using CMP or the like, forming electrode plugs 112, as shown in FIGS. 3A and 3B. The ratio (thickness in the z direction/length in the y direction) of the thickness of the electrode plug 112 in the z direction to the length of the electrode plug 112 in the y direction, that is, the aspect ratio may be 1 or less. A high aspect ratio leads to insufficient filling of the groove with the conductive material of the electrode plug 112 and readily makes the surface of the planarized electrode plug 112 uneven.

Figure 3C:
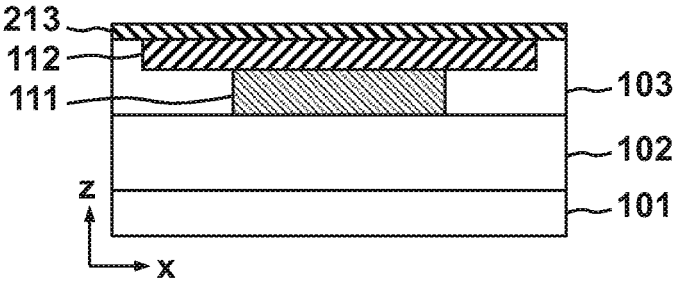
Figure 3D:
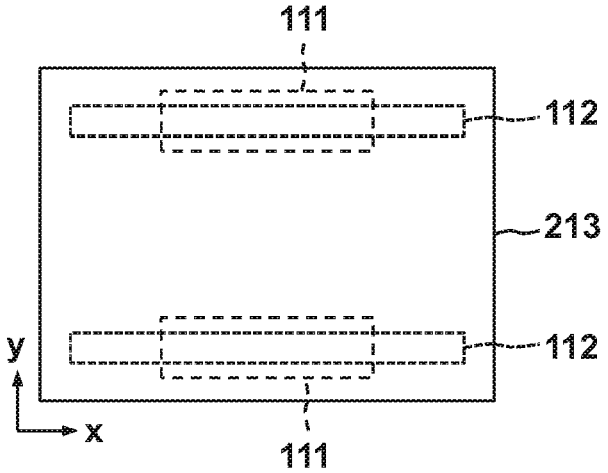
Figure 3E:
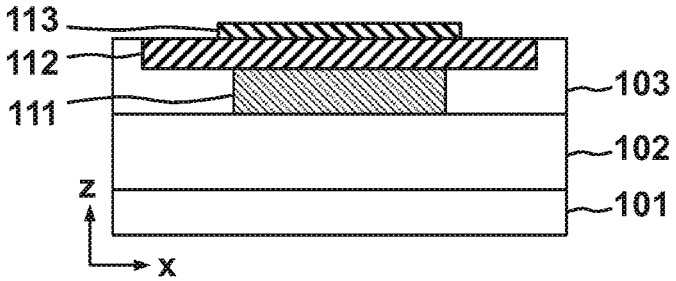
Figure 3F:
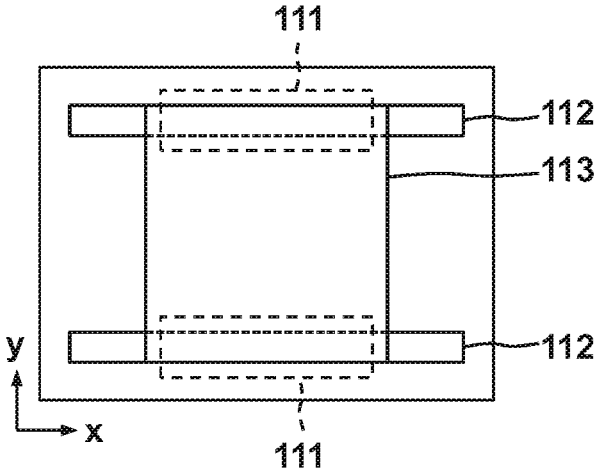

As shown in FIGS. 3C and 3D, a heat generating resistive element material 213 containing tantalum silicon nitride is deposited on the insulating layer 103 and the electrode plugs 112 using sputtering or the like. Tantalum silicon nitride is used for the heat generating resistive element material 213 in this embodiment, but tungsten silicon nitride or the like may be used.

After forming the heat generating resistive element material 213, a mask pattern is formed to cover a predetermined region of the heat generating resistive element material 213 using photolithography. A portion of the heat generating resistive element material 213 that is not covered with the mask pattern is etched using dry etching or the like until the insulating layer 103 and the electrode plugs 112 are exposed, thereby forming a heat generating resistive element 113 shown in FIGS. 3E and 3F.

Figure 3G:
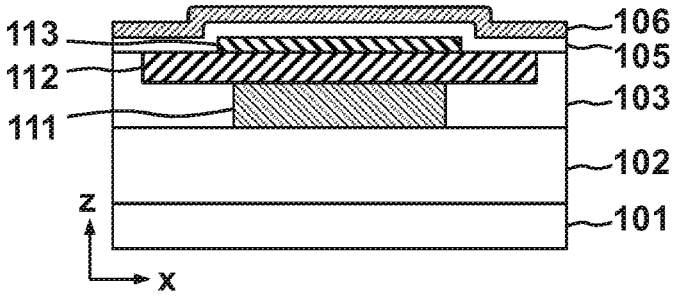
Figure 3H:
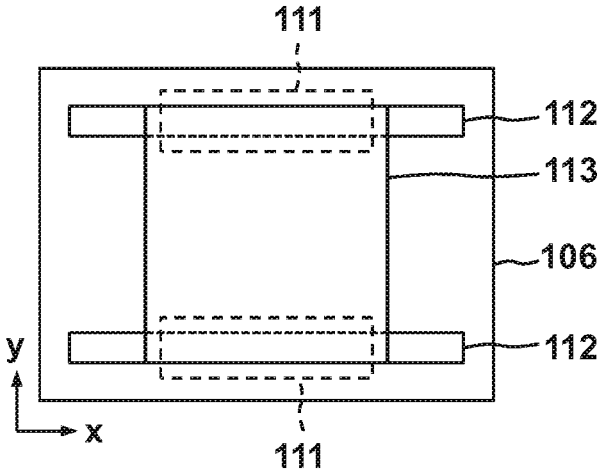

As shown in FIGS. 3G and 3H, a silicon nitride-containing protective layer 105 is deposited using CVD or the like to cover the insulating layer 103, the electrode plugs 112, and the heat generating resistive element 113. Further, a tantalum-containing metal layer 106 is deposited on the protective layer 105 using sputtering or the like. The metal layer 106 is arranged on the protective layer 105 in this embodiment but may not be arranged.

After forming the metal layer 106, a flow path member 107 and an orifice member 108 are formed, thus forming a liquid discharge head substrate 100 shown in FIGS. 1A and 1B. At this time, side walls of the flow path member 107 for constituting a flow path can be arranged between the outer edge of the electrode plug 112 and that of the heat generating resistive element 113 in the x direction. In other words, the flow path member 107 covers an end of the electrode plug 112 including the outer edge in the x direction. The end of the electrode plug 112 in the x direction that readily becomes uneven is covered with the protective layer 105 and the metal layer 106, and rarely contacts the liquid 121 even under the flow path of the liquid 121. Since the flow path member 107 for constituting the flow path of the liquid 121 is arranged above the end of the electrode plug 112 in the x direction, the flow path of the liquid 121 is not formed at the end of the electrode plug 112 in the x direction. Even if the end of the electrode plug 112 in the x direction becomes uneven and coverage with the protective layer 105 is insufficient, the contact between the electrode plug 112 and the liquid 121 can be suppressed.

As described above, according to this embodiment, the length of the electrode plug 112 of the liquid discharge head substrate 100 in the x direction is designed to be larger than the length of the heat generating resistive element 113 in the x direction. This suppresses the contact between the electrode plug 112 or the heat generating resistive element 113, and the liquid 121 and can improve the durability of the liquid discharge head substrate 100.

Figure 4A:
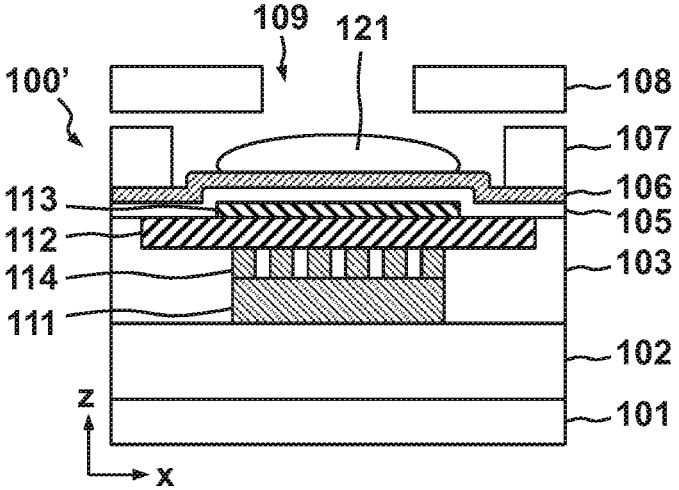
FIGS. 4A and 4B are views showing an example of the structure of a liquid discharge head substrate according to an embodiment of the present invention.
Figure 4B:
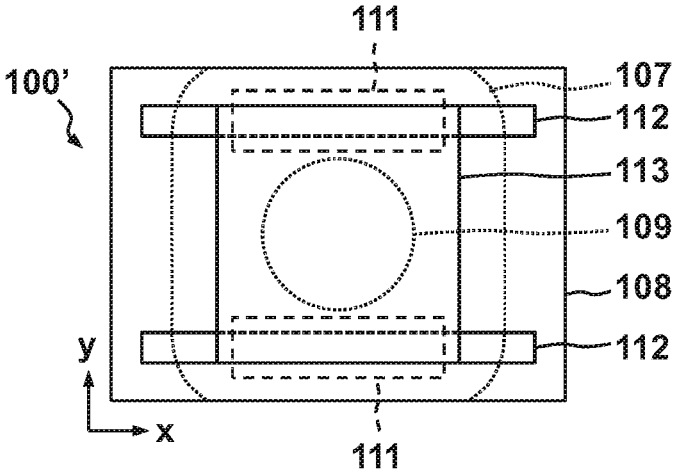
Figure 5A:
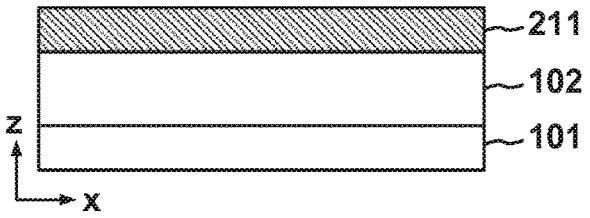
FIGS. 5A to 5H are views showing the manufacturing method of the liquid discharge head substrate in FIGS. 4A and 4B.
Figure 5B:
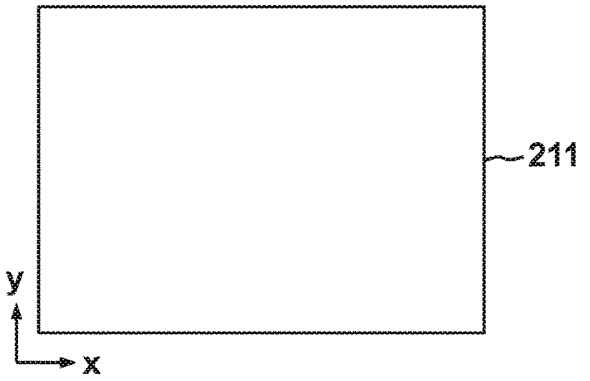
Figure 5C:
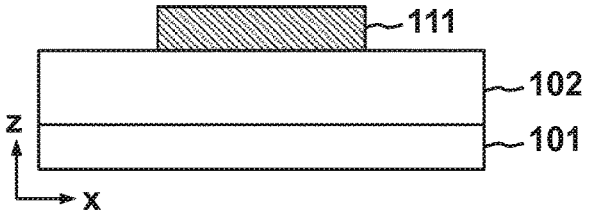
Figure 5D:
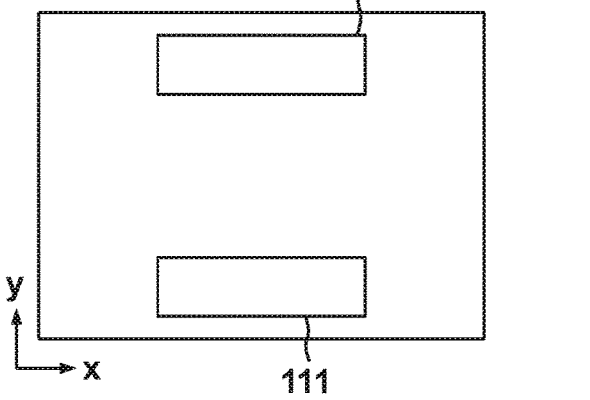
Figure 5E:
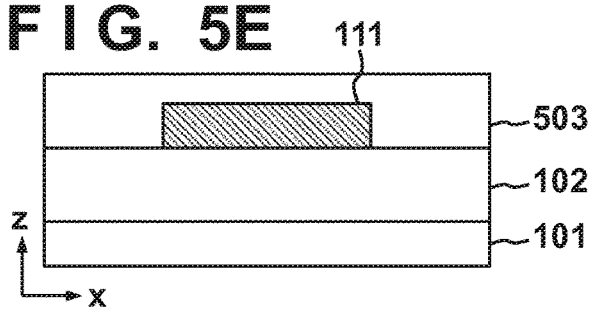
Figure 5F:
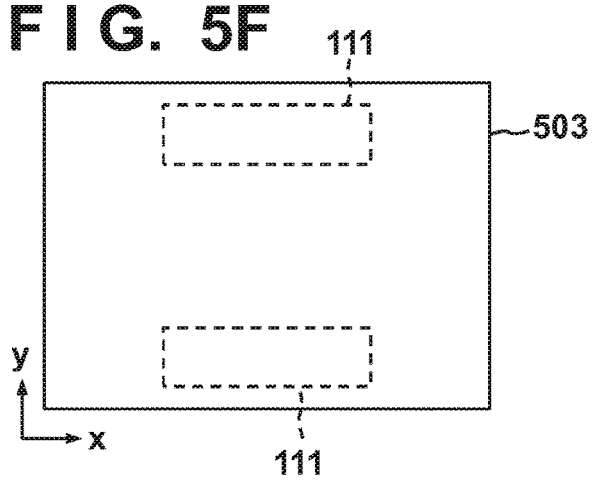
Figure 5G:
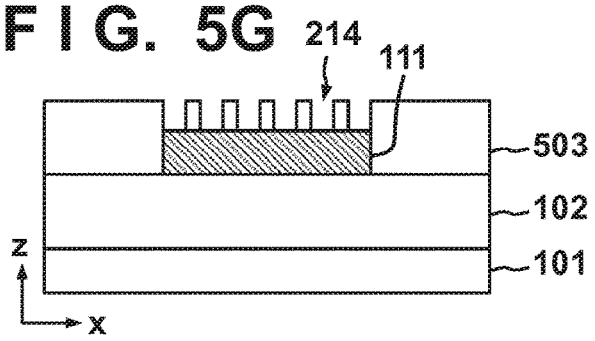
Figure 5H:
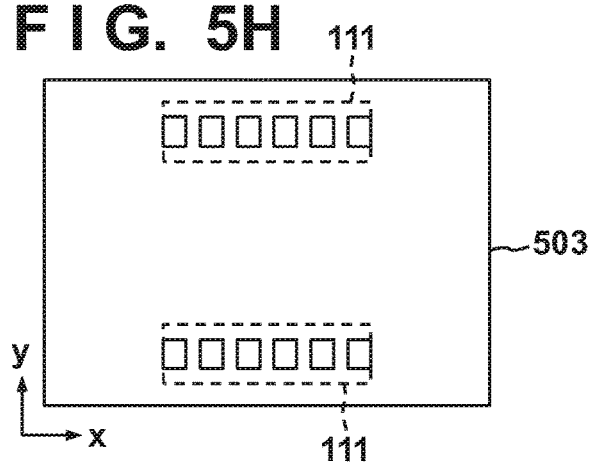

The structure and manufacturing method of a liquid discharge head substrate according to an embodiment of the present invention will be described with reference to FIGS. 4A to 7F. FIGS. 4A and 4B are a sectional view and a plan view, respectively, showing the structure of a liquid discharge head substrate 100' according to the second embodiment of the present invention. In the liquid discharge head substrate 100 according to the first embodiment described above, the conductive pattern 111 and the electrode plug 112 directly contact each other. To the contrary, in the second embodiment, the liquid discharge head substrate 100' further includes a plurality of connecting members 114 that are arranged between electrode plugs 112 and conductive patterns 111 and aligned in the x direction. That is, in the second embodiment, the electrode plugs 112 and the conductive patterns 111 are electrically connected via the connecting members 114. Each of the connecting members 114 may be arranged inside the outer edge of a heat generating resistive element 113 in the x direction, as shown in FIGS. 4A and 4B. The remaining structure of the liquid discharge head substrate 100' can be the same as that in the above-described first embodiment, and a description thereof will not be repeated.

Next, the manufacturing method of the liquid discharge head substrate 100' according to this embodiment will be described with reference to FIGS. 5A to 7F. FIGS. 5A to 7F are sectional views and plan views, respectively, showing steps of forming the liquid discharge head substrate 100'.

Steps shown in FIGS. 5A to 5F can be the same as those shown in FIGS. 2A to 2F and a description thereof will not be repeated. In a step shown in FIGS. 5G and 5H, an insulating layer 503 serving as part of an insulating layer 103 shown in FIG. 4A is formed, and a mask pattern is formed to cover a predetermined region of the insulating layer 503 using photolithography. A portion of the insulating layer 503 that is not covered with the mask pattern is etched using dry etching or the like until the conductive patterns 111 are exposed, thereby forming grooves 214 shown in FIGS. 5G and 5H.

Figure 6A:
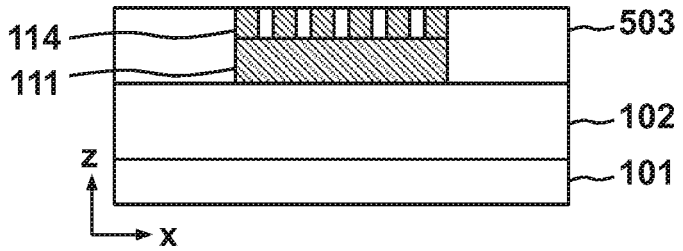
FIGS. 6A to 6H are views showing the manufacturing method of the liquid discharge head substrate in FIGS. 4A and 4B.
Figure 6B:
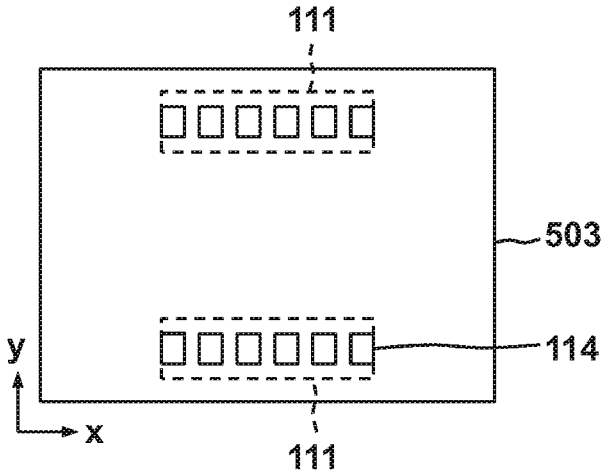

After forming the grooves 214, the grooves 214 formed in the insulating layer 503 are filled with a conductive material containing tungsten or the like using CVD or sputtering. The conductive material is planarized using CMP or the like, forming a plurality of connecting members 114, as shown in FIGS. 6A and 6B.

Figure 6C:
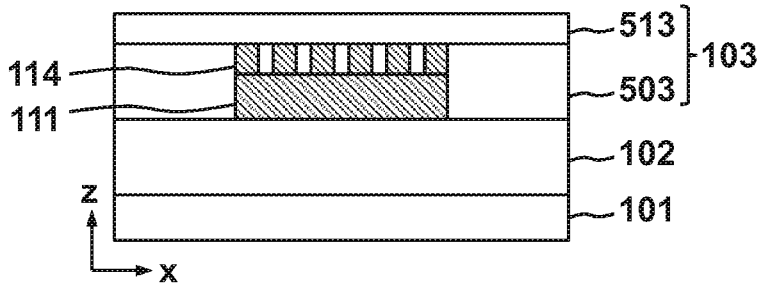
Figure 6D:
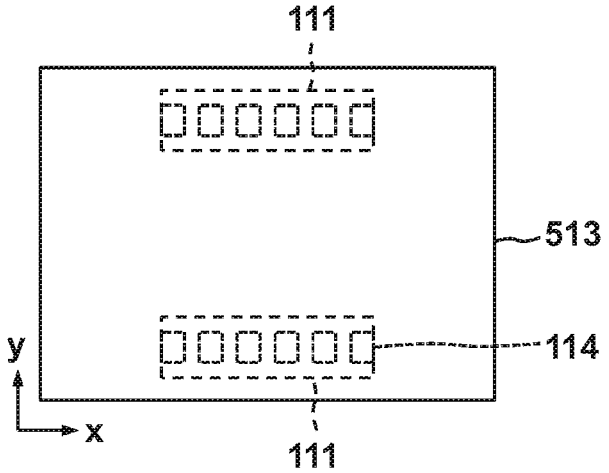

As shown in FIGS. 6C and 6D, an insulating layer 513 is formed on the insulating layer 503 and the connecting members 114. For example, silicon oxide may be formed using CVD or the like for the insulating layer 513. Accordingly, an insulating layer 103 containing the insulating layers 503 and 513 is formed, thereby forming, on the surface of a substrate 101, insulating layers 102 and 103 in which the conductive patterns 111 are buried.

Figure 6E:
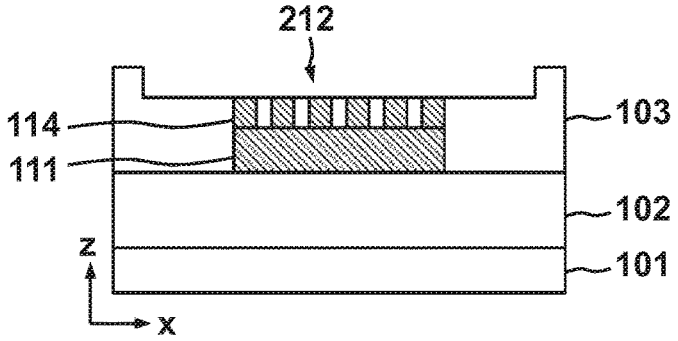
Figure 6F:
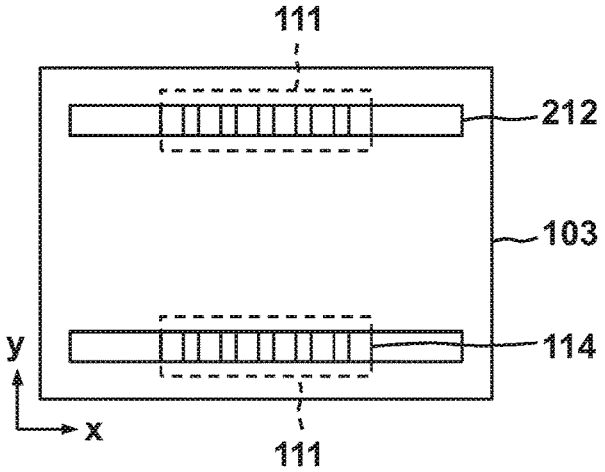

After forming the insulating layer 103, a mask pattern is formed to cover a predetermined region of the insulating layer 103 using photolithography. A portion of the insulating layer 103 that is not covered with the mask pattern is etched using dry etching or the like until the connecting members 114 are exposed. As shown in FIGS. 6E and 6F, grooves 212 through which the connecting members 114 are exposed at the bottoms of the openings are formed.

Figure 6G:
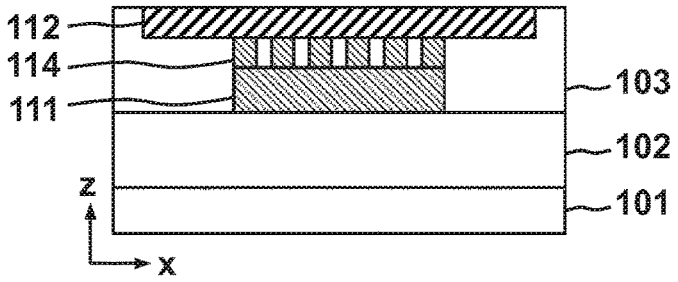
Figure 6H:
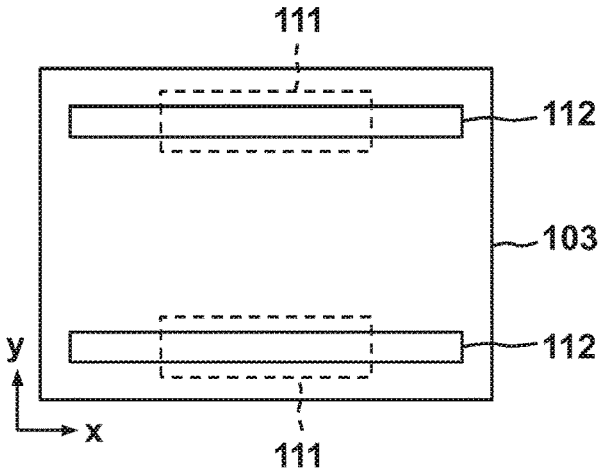
Figure 7A:
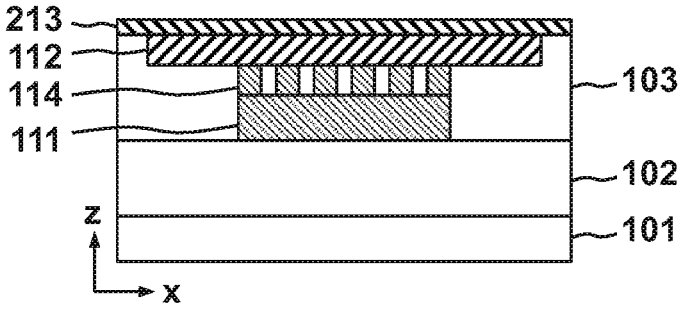
FIGS. 7A to 7F are views showing the manufacturing method of the liquid discharge head substrate in FIGS. 4A and 4B.
Figure 7B:
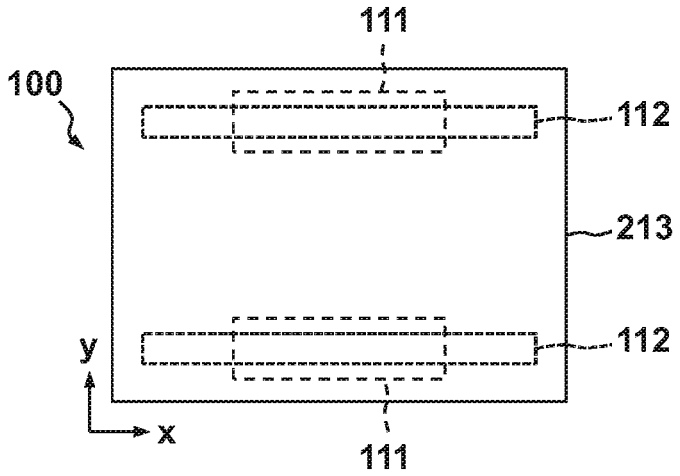
Figure 7C:
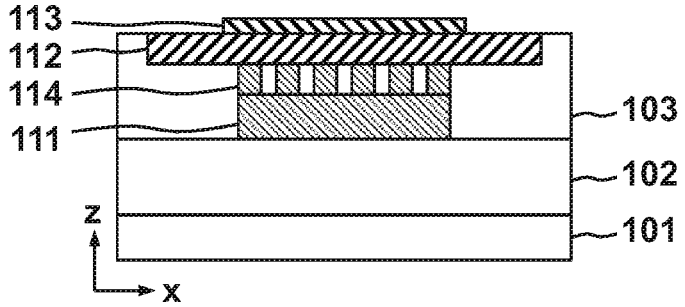
Figure 7D:
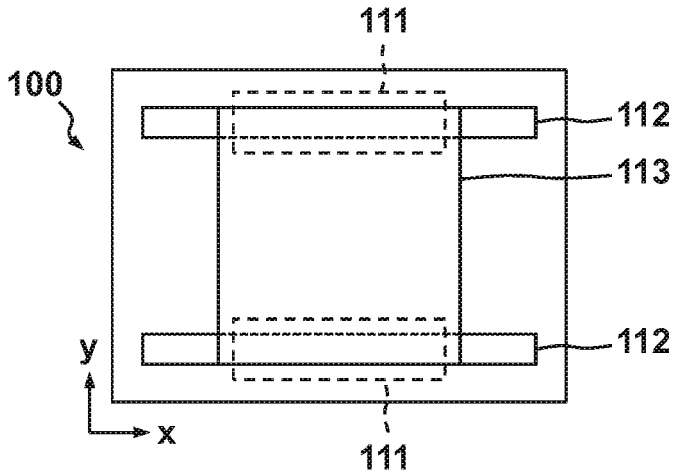
Figure 7E:
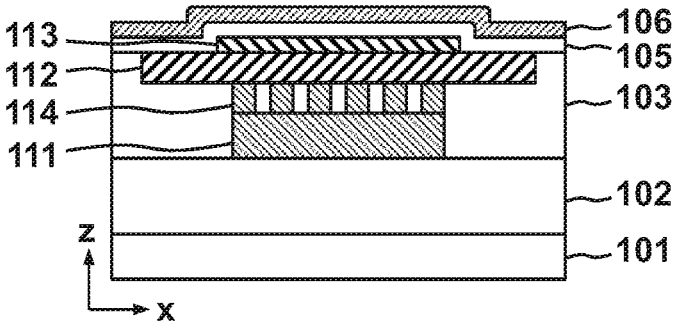
Figure 7F:
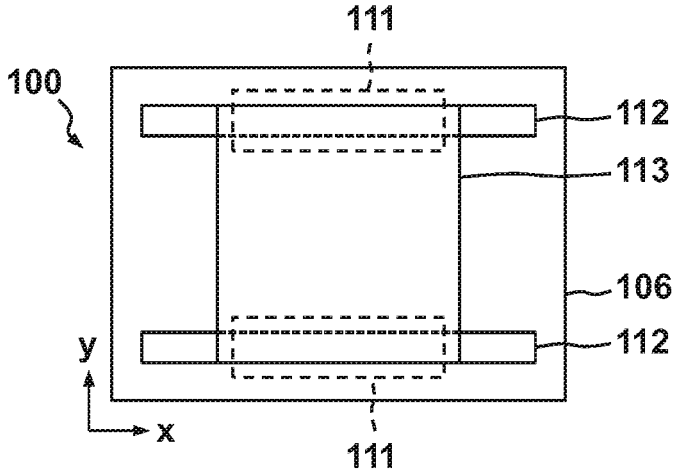

After forming the grooves 212, the grooves 212 formed in the insulating layer 103 are filled with a conductive material containing tungsten or the like using CVD or sputtering. The conductive material is planarized using CMP or the like, forming electrode plugs 112, as shown in FIGS. 6G and 6H.

Steps shown in FIGS. 7A to 7F after forming the electrode plugs 112 can be the same as those shown in FIGS. 3C to 3H and a description thereof will not be repeated. By using these steps, a liquid discharge head substrate 100' shown in FIGS. 4A and 4B is formed.

Even in this embodiment, as in the above-described first embodiment, the length of the electrode plug 112 in the x direction is larger than the length of the heat generating resistive element 113 in the x direction in a projection orthogonal to the surface of the substrate 101. That is, the outer edge of the electrode plug 112 is arranged outside the outer edge of the heat generating resistive element 113 in the x direction. Even if the end of the electrode plug 112 becomes uneven, a liquid 121 rarely contacts the end of the electrode plug 112. As a result, the durability of the liquid discharge head substrate 100' can be improved.

Figure 8A:
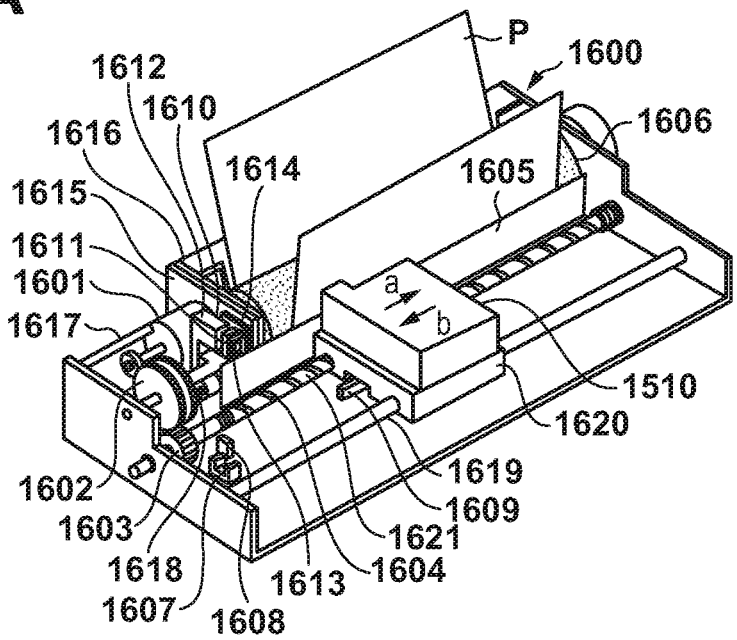
FIGS. 8A to 8D are views showing an example of the arrangement of a liquid discharge apparatus using the liquid discharge head substrate in FIGS. 1A and 1B.

A liquid discharge apparatus using the above-described liquid discharge head substrate 100 or 100' will be explained. FIG. 8A exemplifies the internal arrangement of a liquid discharge apparatus 1600 typified by an inkjet printer, a facsimile apparatus, or a copying machine. In this example, the liquid discharge apparatus may also be called a printing apparatus. The liquid discharge apparatus 1600 includes a liquid discharge head 1510 that discharges a liquid (in this example, ink or a printing material) to a predetermined medium P (in this example, a printing medium such as paper). In this example, the liquid discharge head may also be called a printhead. The liquid discharge head 1510 is mounted on a carriage 1620, and the carriage 1620 can be attached to a lead screw 1621 having a helical groove 1604. The lead screw 1621 can rotate in synchronization with rotation of a driving motor 1601 via driving force transmission gears 1602 and 1603. The liquid discharge head 1510 can move in a direction indicated by an arrow a orb along a guide 1619 together with the carriage 1620.

The medium P is pressed by a paper press plate 1605 in the carriage moving direction and fixed to a platen 1606. The liquid discharge apparatus 1600 performs liquid discharge (in this example, printing) to the medium P conveyed on the platen 1606 by a conveyance unit (not shown) by reciprocating the liquid discharge head 1510.

The liquid discharge apparatus 1600 confirms the position of a lever 1609 provided on the carriage 1620 via photocouplers 1607 and 1608, and switches the rotational direction of the driving motor 1601. A support member 1610 supports a cap member 1611 for covering the nozzle (liquid orifice or simply orifice) of the liquid discharge head 1510. A suction portion 1612 performs recovery processing of the liquid discharge head 1510 by sucking the interior of the cap member 1611 via an intra-cap opening 1613. A lever 1617 is provided to start recovery processing by suction, and moves along with movement of a cam 1618 engaged with the carriage 1620. A driving force from the driving motor 1601 is controlled by a well-known transmission mechanism such as a clutch switch.

A main body support plate 1616 supports a moving member 1615 and a cleaning blade 1614. The moving member 1615 moves the cleaning blade 1614 to perform recovery processing of the liquid discharge head 1510 by wiping. The liquid discharge apparatus 1600 includes a controller (not shown) and the controller controls driving of each mechanism described above.

Figure 8B:
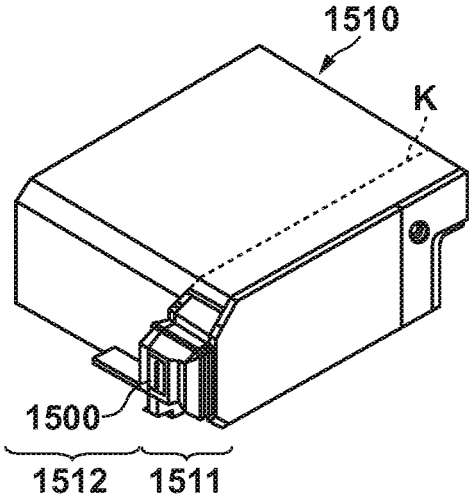

FIG. 8B exemplifies the outer appearance of the liquid discharge head 1510. The liquid discharge head 1510 can include a head portion 1511 having a plurality of nozzles 1500, and a tank (liquid storage portion) 1512 that holds a liquid to be supplied to the head portion 1511. The tank 1512 and the head portion 1511 can be separated at, for example, a broken line K and the tank 1512 is interchangeable. The liquid discharge head 1510 has an electrical contact (not shown) for receiving an electrical signal from the carriage 1620 and discharges a liquid in accordance with the electrical signal. The tank 1512 has a fibrous or porous liquid holding member (not shown) and the liquid holding member can hold a liquid.

Figure 8C:
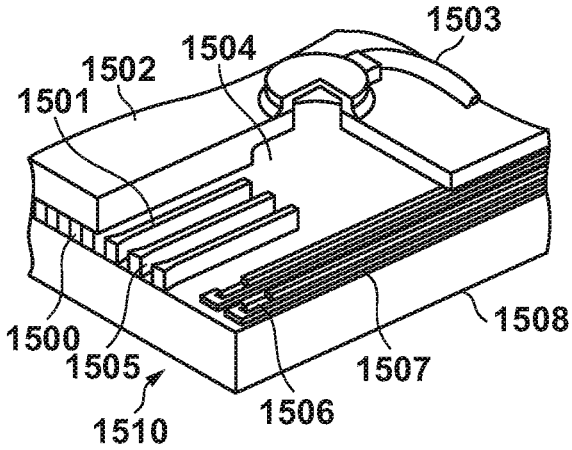

FIG. 8C exemplifies the internal arrangement of the liquid discharge head 1510. The liquid discharge head 1510 includes a base 1508, flow path wall members 1501 that are arranged on the base 1508 and form flow paths 1505, and a top plate 1502 having a liquid supply path 1503. The base 1508 may be either of the above-described liquid discharge head substrates 100 and 100'. As discharge elements or liquid discharge elements, heaters 1506 (electrothermal transducers) are arrayed on the substrate (liquid discharge head substrate) of the liquid discharge head 1510 in correspondence with the respective nozzles 1500. Each heater 1506 is driven to generate heat by turning on a driving element (a switching element such as a transistor) provided in correspondence with the heater 1506.

A liquid from the liquid supply path 1503 is stored in a common liquid chamber 1504 and supplied to each nozzle 1500 via the corresponding flow path 1505. The liquid supplied to each nozzle 1500 is discharged from the nozzle 1500 in response to driving of the heater 1506 corresponding to the nozzle 1500.

Figure 8D:
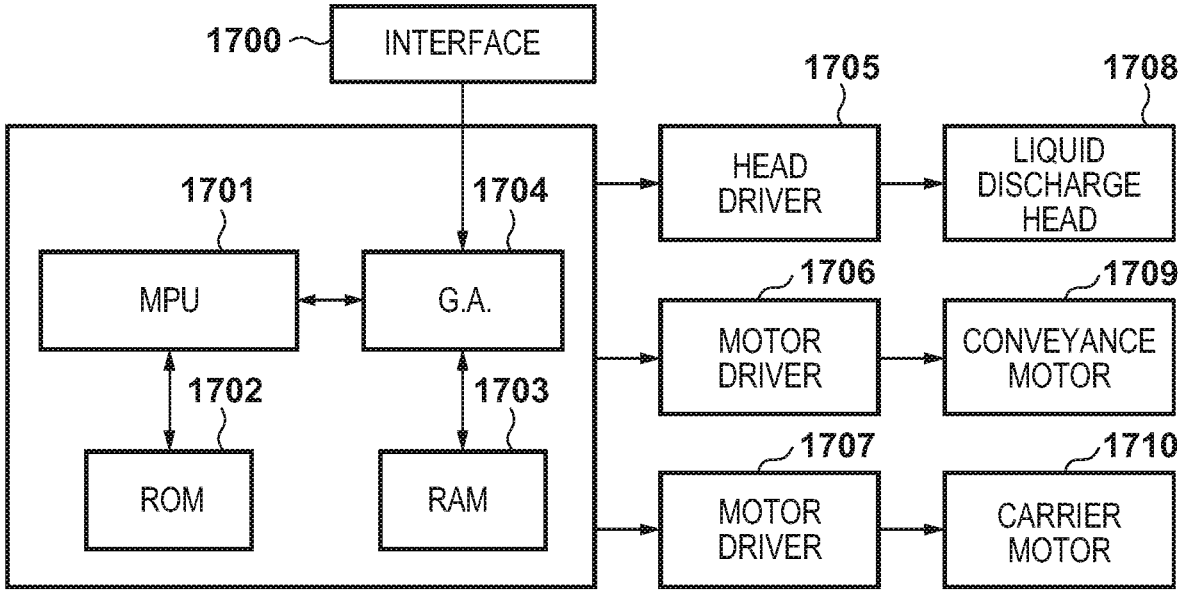

FIG. 8D exemplifies the system arrangement of the liquid discharge apparatus 1600. The liquid discharge apparatus 1600 includes an interface 1700, an MPU 1701, a ROM 1702, a RAM 1703, and a gate array (G.A.) 1704. The interface 1700 receives from the outside an external signal for executing liquid discharge. The ROM 1702 stores a control program to be executed by the MPU 1701. The RAM 1703 saves various signals and data such as the above-mentioned external signal for liquid discharge and data supplied to the liquid discharge head 1708. The gate array 1704 performs supply control of data to the liquid discharge head 1708 and control of data transfer between the interface 1700, the MPU 1701, and the RAM 1703.

The liquid discharge apparatus 1600 further includes a head driver 1705, motor drivers 1706 and 1707, a conveyance motor 1709, and a carrier motor 1710. The carrier motor 1710 conveys a liquid discharge head 1708. The conveyance motor 1709 conveys the medium P. The head driver 1705 drives the liquid discharge head 1708. The motor drivers 1706 and 1707 drive the conveyance motor 1709 and the carrier motor 1710, respectively.

When a driving signal is input to the interface 1700, it can be converted into data for liquid discharge between the gate array 1704 and the MPU 1701. Each mechanism performs a desired operation in accordance with this data. In this manner, the liquid discharge head 1708 is driven.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-077142, filed Apr. 12, 2018, which is hereby incorporated by reference herein in its entirety.

What is claimed is:

1. A liquid discharge head substrate comprising:

a substrate;

an insulating layer arranged above a surface of the substrate;

conductive patterns arranged in the insulating layer;

a heat generating resistive element arranged above the insulating layer and configured to generate heat energy for discharging a liquid;

a protective layer covering the heat generating resistive element; and electrode plugs electrically connecting the heat generating resistive element and the conductive patterns, wherein the heat generating resistive element and the electrode plugs are arranged in contact with each other and are arranged such that an orthogonal projection of the heat generating resistive element onto the surface of the substrate overlaps with orthogonal projections of the electrode plugs onto the surface of the substrate, a current flows through the heat generating resistive element in a first direction parallel to the surface of the substrate, a length of the electrode plug in the first direction is smaller than a length of the heat generating resistive element in the first direction, and in a second direction parallel to the surface of the substrate and crossing the first direction, a length of the electrode plug in the second direction is larger than a length of the heat generating resistive element in the second direction.

2. The liquid discharge head substrate according to claim 1, wherein a ratio of a thickness of the electrode plug to the length of the electrode plug in the first direction is not higher than 1.

3. The liquid discharge head substrate according to claim 1, wherein each outer edge of the electrode plug is arranged outside an outer edge of the heat generating resistive element in the second direction.

4. The liquid discharge head substrate according to claim 1, wherein a length from an outer edge of the electrode plug in the second direction to an outer edge of the heat generating resistive element is larger than a length of the electrode plug in the first direction.

5. The liquid discharge head substrate according to claim 1, wherein each outer edge of the electrode plug in the first direction and the heat generating resistive element are arranged such that an orthogonal projection of each outer edge of the electrode plug in the first direction onto the surface of the substrate overlaps with orthogonal projections of the heat generating resistive element onto the surface of the substrate in a region of the electrode plug where the electrode plug and the heat generating resistive element are arranged such that an orthogonal projection of the heat generating resistive element onto the surface of the substrate overlaps with orthogonal projections of the electrode plugs onto the surface of the substrate.

6. The liquid discharge head substrate according to claim 1, wherein the length of the electrode plug in the second direction is larger than the length of the electrode plug in the first direction.

7. The liquid discharge head substrate according to claim 1, wherein the protective layer contains an insulator, and the liquid discharge head substrate further includes a metal layer on the protective layer.

8. The liquid discharge head substrate according to claim 7, wherein the liquid discharge head substrate further includes a flow path member arranged above the protective layer to surround the heat generating resistive element in order to constitute a flow path of the liquid, a side wall of the flow path member is arranged between an outer edge of the electrode plug and an outer edge of the heat generating resistive element in the second direction, and the flow path member is arranged on the metal layer.

9. The liquid discharge head substrate according to claim 1, wherein the liquid discharge head substrate further includes a flow path member arranged above the protective layer to surround the heat generating resistive element in order to constitute a flow path of the liquid, and a side wall of the flow path member is arranged between an outer edge of the electrode plug and an outer edge of the heat generating resistive element in the second direction.

10. The liquid discharge head substrate according to claim 1, wherein the liquid discharge head substrate further includes, above the protective layer, an orifice member including an orifice for discharging the liquid, and the orifice for discharging is arranged above the heat generating resistive element.

11. The liquid discharge head substrate according to claim 1, wherein the liquid discharge head substrate further includes a plurality of connecting members that are arranged between the electrode plugs and the conductive patterns and aligned in the second direction.

12. The liquid discharge head substrate according to claim 11, wherein the plurality of connecting members are arranged inside an outer edge of the heat generating resistive element in the second direction.

13. A liquid discharge head comprising:

a liquid discharge head substrate according to claim 1, and an orifice for discharging, discharge of a liquid from which is controlled by the liquid discharge head substrate.

14. A liquid discharge apparatus comprising:

a liquid discharge head according to claim 13, and a unit configured to supply a driving signal for causing the liquid discharge head to discharge a liquid.

15. A liquid discharge head substrate comprising:

a substrate;

an insulating layer arranged above a surface of the substrate;

a heat generating resistive element arranged above the insulating layer and configured to generate heat energy for discharging a liquid;

a protective layer covering the heat generating resistive element;

a first conductive pattern and a second conductive pattern arranged in the insulating layer;

a first electrode plug configured to electrically connect the heat generating resistive element and the first conductive pattern; and a second electrode plug configured to electrically connect the heat generating resistive element and the second conductive pattern, wherein the first electrode plug and the second electrode plug are arranged in contact with the heat generating resistive element and are arranged such that an orthogonal projection of the heat generating resistive element onto the surface of the substrate overlaps with each orthogonal projection of the first and second electrode plugs onto the surface of the substrate, the first electrode plug and the second electrode plug are aligned in a first direction parallel to the surface of the substrate, and in a second direction parallel to the surface of the substrate and crossing the first direction, a length of each of the first electrode plug and the second electrode plug in the second direction is larger than a length of the heat generating resistive element in the second direction.

16. The liquid discharge head substrate according to claim 15, wherein a ratio of a thickness of the first electrode plug to the length of the first electrode plug in the first direction is not higher than 1, and a ratio of a thickness of the second electrode plug to the length of the second electrode plug in the first direction is not higher than 1.

17. The liquid discharge head substrate according to claim 15, wherein in the second direction, each outer edge of the first electrode plug is arranged outside an outer edge of the heat generating resistive element, and each outer edge of the second electrode plug is arranged outside the outer edge of the heat generating resistive element.

18. The liquid discharge head substrate according to claim 15, wherein a length from an outer edge of the first electrode plug in the second direction to an outer edge of the heat generating resistive element is larger than a length of the first electrode plug in the first direction, and a length from an outer edge of the second electrode plug in the second direction to the outer edge of the heat generating resistive element is larger than a length of the second electrode plug in the first direction.

19. The liquid discharge head substrate according to claim 15, wherein each outer edge of the first electrode plug in the first direction and the heat generating resistive element are arranged such an orthogonal projection of each outer edge of the first electrode plug in the first direction onto the surface of the substrate overlaps with orthogonal projections of the heat generating resistive element onto the surface of the substrate in a region of the first electrode plug where the first electrode plug and the heat generating resistive element are arranged such that an orthogonal projection of the first electrode plug onto the surface of the substrate overlaps with orthogonal projections of the heat generating resistive element onto the surface of the substrate, and each outer edge of the second electrode plug in the first direction and the heat generating resistive element are arranged such an orthogonal projection of each outer edge of the first electrode plug in the first direction onto the surface of the substrate overlaps with orthogonal projections of the heat generating resistive element onto the surface of the substrate in a region of the second electrode plug where the second electrode plug and the heat generating resistive element are arranged such that an orthogonal projection of the second electrode plug onto the surface of the substrate overlaps with orthogonal projections of the heat generating resistive element onto the surface of the substrate.

20. The liquid discharge head substrate according to claim 15, wherein the length of the first electrode plug in the second direction is larger than the length of the first electrode plug in the first direction, and the length of the second electrode plug in the second direction is larger than the length of the second electrode plug in the first direction.

21. The liquid discharge head substrate according to claim 15, wherein the protective layer contains an insulator, and the liquid discharge head substrate further includes a metal layer on the protective layer.

22. The liquid discharge head substrate according to claim 21, wherein the liquid discharge head substrate further includes a flow path member arranged on the protective layer to surround the heat generating resistive element in order to constitute a flow path of the liquid, a side wall of the flow path member is arranged between an outer edge of the first electrode plug and an outer edge of the heat generating resistive element in the second direction, a side wall of the flow path member is arranged between an outer edge of the second electrode plug and an outer edge of the heat generating resistive element in the second direction, and the flow path member is arranged on the metal layer.

23. The liquid discharge head substrate according to claim 15, wherein the liquid discharge head substrate further includes a flow path member arranged on the protective layer to surround the heat generating resistive element in order to constitute a flow path of the liquid, a side wall of the flow path member is arranged between an outer edge of the first electrode plug and an outer edge of the heat generating resistive element in the second direction, and a side wall of the flow path member is arranged between an outer edge of the second electrode plug and an outer edge of the heat generating resistive element in the second direction.

24. The liquid discharge head substrate according to claim 15, wherein the liquid discharge head substrate further includes, above the protective layer, an orifice member including an orifice for discharging the liquid, and the orifice for discharging is arranged above the heat generating resistive element.

25. The liquid discharge head substrate according to claim 15, wherein the liquid discharge head substrate further includes a plurality of connecting members that are arranged between the first electrode plug and the first conductive pattern and between the second electrode plug and the second conductive pattern and aligned in the second direction.

26. The liquid discharge head substrate according to claim 25, wherein the plurality of connecting members are arranged inside an outer edge of the heat generating resistive element in the second direction.

* * * * *